US010088215B2

(12) United States Patent
Klingshirn et al.

(10) Patent No.: US 10,088,215 B2
(45) Date of Patent: Oct. 2, 2018

(54) REFRIGERATION DEVICE HAVING A PLURALITY OF REFRIGERATION COMPARTMENTS

(71) Applicant: BSH HAUSGERAETE GMBH, Munich (DE)

(72) Inventors: Astrid Klingshirn, Zusmarshausen (DE); Niels Liengaard, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 90 days.

(21) Appl. No.: 15/104,635

(22) PCT Filed: Dec. 16, 2014

(86) PCT No.: PCT/EP2014/078089
§ 371 (c)(1),
(2) Date: Jun. 15, 2016

(87) PCT Pub. No.: WO2015/091571
PCT Pub. Date: Jun. 25, 2015

(65) Prior Publication Data

US 2016/0320116 A1 Nov. 3, 2016

(30) Foreign Application Priority Data

Dec. 18, 2013 (DE) ..... 10 2013 226 341

(51) Int. Cl.
*F25D 11/02* (2006.01)
*F25B 41/06* (2006.01)

(52) U.S. Cl.
CPC ..... *F25D 11/022* (2013.01); *F25B 41/062* (2013.01); *F25B 2341/0662* (2013.01); *F25D 2700/12* (2013.01)

(58) Field of Classification Search
CPC .. F25D 11/022; F25D 2700/12; F25B 41/062; F25B 41/0622; F25B 2600/2513
(Continued)

(56) References Cited

U.S. PATENT DOCUMENTS 2,691,872 A 10/1954 Schaefer
2,693,679 A 11/1954 Staebler
(Continued)

FOREIGN PATENT DOCUMENTS

CN 1486414 A 3/2004
DE 2236480 A1 2/1974
(Continued)

OTHER PUBLICATIONS

Ron White, How Computers Work, 1999, Que Corporation, Millenium Edition, p. 262.*

*Primary Examiner* — Marc Norman
(74) *Attorney, Agent, or Firm* — Laurence A. Greenberg; Werner H. Stemer; Ralph E. Locher

(57) ABSTRACT

A refrigeration device includes a first refrigeration compartment for storing refrigerated goods at a first temperature, the first refrigeration compartment including a first evaporator with a first controllable expansion valve at the refrigerant inlet of the first evaporator, and a second refrigeration compartment for storing refrigerated goods at a second temperature, the second refrigeration compartment including a second evaporator with a second controllable expansion valve at the refrigerant inlet of the second evaporator. A refrigerant outlet of the first evaporator is connected to the second controllable expansion valve at the refrigerant inlet of the second evaporator.

12 Claims, 3 Drawing Sheets

(58) Field of Classification Search
USPC ..... 62/198, 222
See application file for complete search history.

(56) References Cited

U.S. PATENT DOCUMENTS

| | | | | | |
|---|---|---|---|---|---|
| 5,103,650 | A | * | 4/1992 | Jaster | F25B 1/10 62/198 |
| 5,134,859 | A | * | 8/1992 | Jaster | F25B 5/04 62/198 |
| 5,150,583 | A | * | 9/1992 | Jaster | F25B 1/10 62/179 |
| 5,431,026 | A | * | 7/1995 | Jaster | F25B 5/04 62/198 |
| 6,775,998 | B2 | | 8/2004 | Yuasa et al. | |

FOREIGN PATENT DOCUMENTS

| | | | |
|---|---|---|---|
| EP | 1344997 | A1 | 9/2003 |
| JP | 2001108319 | A | 4/2001 |
| JP | 2001133112 | A | 5/2001 |

* cited by examiner

REFRIGERATION DEVICE HAVING A PLURALITY OF REFRIGERATION COMPARTMENTS

BACKGROUND OF THE INVENTION

Field of the Invention

The present invention relates to a refrigeration device having a plurality of refrigeration compartments for storing refrigerated goods at different temperatures.

Provision can be made in refrigeration devices for special compartments, such as for instance defrost compartments or stay-warm compartments, which can be set to up to 60° C. The temperatures above ambient temperature are realized using electrical heaters. Without heaters, the temperatures in the individual storage compartments can only be regulated to a degree. By setting a compressor runtime, temperature differences of +1-3K can be generated.

Some special devices, such as wine chillers, operate over larger temperature ranges. The temperature ranges comprise for instance 5-22° C. in up to three temperature zones. These special devices are regulated by setting the operating time of the respective evaporator. Other devices have valves in an air duct, which are opened gradually in order to achieve individual temperature-controlled zones. However, these devices only have one evaporator with a fixed evaporation temperature.

BRIEF SUMMARY OF THE INVENTION

It is the object underlying the invention to specify a refrigeration device in which the individual temperatures in a plurality of refrigeration compartments can be efficiently controlled.

This object is achieved by the subject matter with the features as claimed in the independent claim. Advantageous embodiments of the invention form the subject matter of the figures, the description and the dependent claims.

According to one aspect of the invention, the object is achieved by a refrigeration device having a first refrigeration compartment for storing refrigerated goods at a first temperature, said first refrigeration compartment comprising a first evaporator with a first controllable expansion valve at the refrigerant inlet of the first evaporator and a second refrigeration compartment for storing refrigerated goods at a second temperature, said second refrigeration compartment comprising a second evaporator with a second controllable expansion valve at the refrigerant inlet of the second evaporator, characterized in that a refrigerant outlet of the first evaporator is connected to the second controllable expansion valve at the refrigerant inlet of the second evaporator.

A refrigeration device is in particular understood to mean a domestic refrigeration device, in other words a refrigeration device which is used for housekeeping purposes in homes or in the field of gastronomy, and serves in particular to store food and/or beverages at certain temperatures, like for instance a refrigerator, an upright freezer, a fridge/freezer, a chest freezer or a wine chiller.

In an advantageous embodiment of the refrigeration device, the refrigeration device comprises a control unit for controlling the expansion valves. As a result the technical advantage is achieved for instance such that the expansion valves can be activated centrally by a control unit.

In a further advantageous embodiment of the refrigeration device, the control unit has a non-volatile memory for saving a control program. As a result, the technical advantage is achieved for instance in that the control program can be updated as required.

In a further advantageous embodiment of the refrigeration device, the control unit is embodied to control the first and second expansion valve such that a flow of refrigerant through the first evaporator remains constant. As a result, the technical advantage is achieved for instance in that the temperature in the first refrigeration compartment can be changed without influencing the temperature in the second refrigeration compartment.

In a further advantageous embodiment of the refrigeration device, the control unit is embodied to control the first and second expansion valve such that a flow-through through the first expansion valve is increased if a flow-through through the second expansion valve is reduced. As a result, the technical advantage is likewise achieved for instance in that the temperature in the first refrigeration compartment can be changed without influencing the temperature in the second refrigeration compartment.

In a further advantageous embodiment of the refrigeration device, the control unit is embodied to control the first and second expansion valve such that a flow-through through the first expansion valve is reduced if a flow-through through the second expansion valve is increased. As a result, the technical advantage is likewise achieved for instance in that the temperature in the first refrigeration compartment can be changed without influencing the temperature in the second refrigeration compartment.

In a further advantageous embodiment of the refrigeration device, the first temperature is higher than the second temperature. As a result, the technical advantage is achieved for instance in that the temperatures of the refrigeration compartments can be set in sequence starting from the highest temperature.

In a further advantageous embodiment of the refrigeration device, the second refrigeration compartment is a freezer compartment for storing refrigerated goods at a temperature below 0° C. As a result, the technical advantage is achieved for instance in that excess refrigeration capacity in the freezer compartment can be absorbed.

In a further advantageous embodiment of the refrigeration device, the refrigeration device comprises a compressor with a regulatable speed. As a result, the technical advantage is achieved in that the refrigeration capacity of the refrigeration device can be changed.

In a further advantageous embodiment of the refrigeration device, the control unit is embodied to control the speed of the compressor on the basis of a predetermined refrigeration capacity. As a result, the technical advantage is achieved for instance in that the refrigeration capacity of the refrigeration device can be controlled by the control unit for the expansion valves.

In a further advantageous embodiment of the refrigeration device, the first refrigeration compartment comprises a first temperature sensor and the second refrigeration compartment comprises a second temperature sensor. As a result, the technical advantage is achieved for instance in that a feedback loop exists for the temperature.

In a further advantageous embodiment of the refrigeration device, the control unit is embodied to control the first expansion valve and the second expansion valve on the basis of a first temperature measured value from the first temperature sensor and a second temperature measured value from the second temperature sensor. As a result, the technical advantage is achieved for instance in that the temperature in the refrigeration compartments can be regulated as a function of a measured temperature.

In a further advantageous embodiment of the refrigeration device, the first or second expansion valve is steplessly adjustable. As a result, the technical advantage is achieved for instance in that a fine and precise setting of the temperatures is achieved.

In a further advantageous embodiment of the refrigeration device, the first or second expansion valve comprises a screw facility with a linear stroke in order to regulate the flow of refrigerant. As a result, the technical advantage is achieved for instance in that a proportional valve with a steplessly controllable flow-through is easily realized.

In a further advantageous embodiment of the refrigeration device, the refrigeration device comprises a third refrigeration compartment for storing refrigerated goods at a third temperature, said third refrigeration compartment comprising a third evaporator with a third controllable expansion valve at the refrigerant inlet of the third evaporator and a refrigerant outlet of the second evaporator is connected to the third controllable expansion valve at the refrigerant inlet of the third evaporator. As a result, the technical advantage is achieved for instance in that the temperature in a plurality of refrigeration compartments can be regulated.

BRIEF DESCRIPTION OF THE SEVERAL VIEWS OF THE DRAWING

Exemplary embodiments of the invention are shown in the drawings and are described in more detail below, in which.

DESCRIPTION OF THE INVENTION

Figure 1:
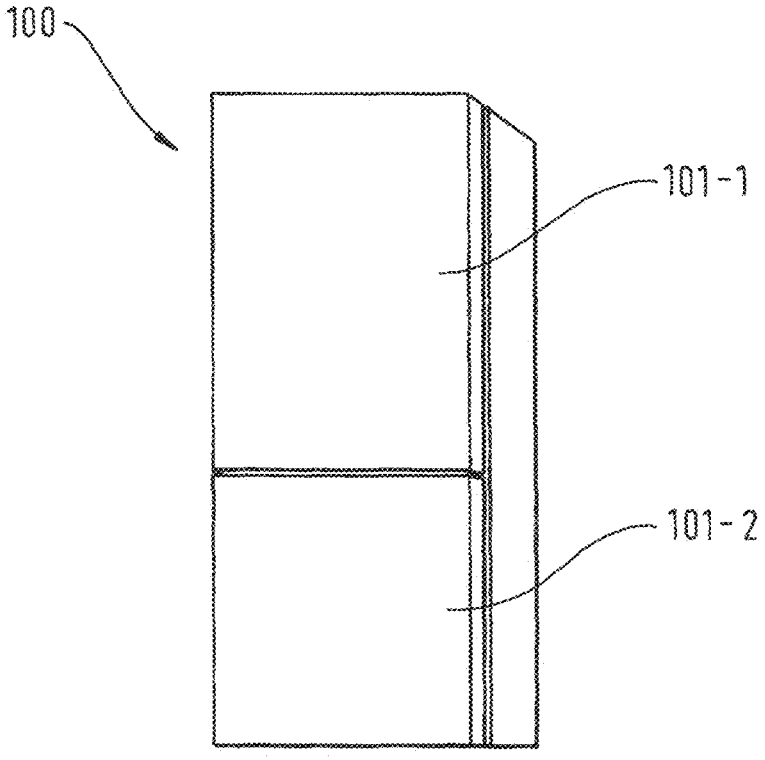
FIG. 1 shows a schematic view of a refrigeration device.

FIG. 1 shows a schematic view of a refrigeration device 100 having a first refrigeration compartment 101-1 for storing refrigerated goods at a first temperature, for instance a refrigerator compartment, and a second refrigeration compartment 101-2 for storing refrigerated goods at a second temperature, for instance a freezer compartment.

The refrigeration device 100 serves for instance to cool food and comprises a refrigerant circuit with an evaporator, a compressor, a condenser and a throttle organ. The evaporator is a heat exchanger, in which, after expansion, the liquid refrigerant is evaporated by absorbing heat from the medium to be cooled, i.e. the air in the inside of the refrigeration device.

The compressor is a mechanically operated component, which takes refrigerant vapor from the evaporator and outputs the same to the condenser at a higher pressure. The condenser is a heat exchanger, in which, after compression, the evaporated refrigerant is condensed by outputting heat to an outer cooling medium, i.e. the ambient air. The throttle organ is an apparatus for continuously reducing the pressure by means of cross-sectional constriction.

The refrigerant is a fluid, which is used for transmitting heat in the cold-generating system, which absorbs heat at low temperatures and at a low pressure of the fluid and outputs heat at a higher temperature and higher pressure of the fluid, wherein this usually involves state changes in the fluid.

Figure 2:
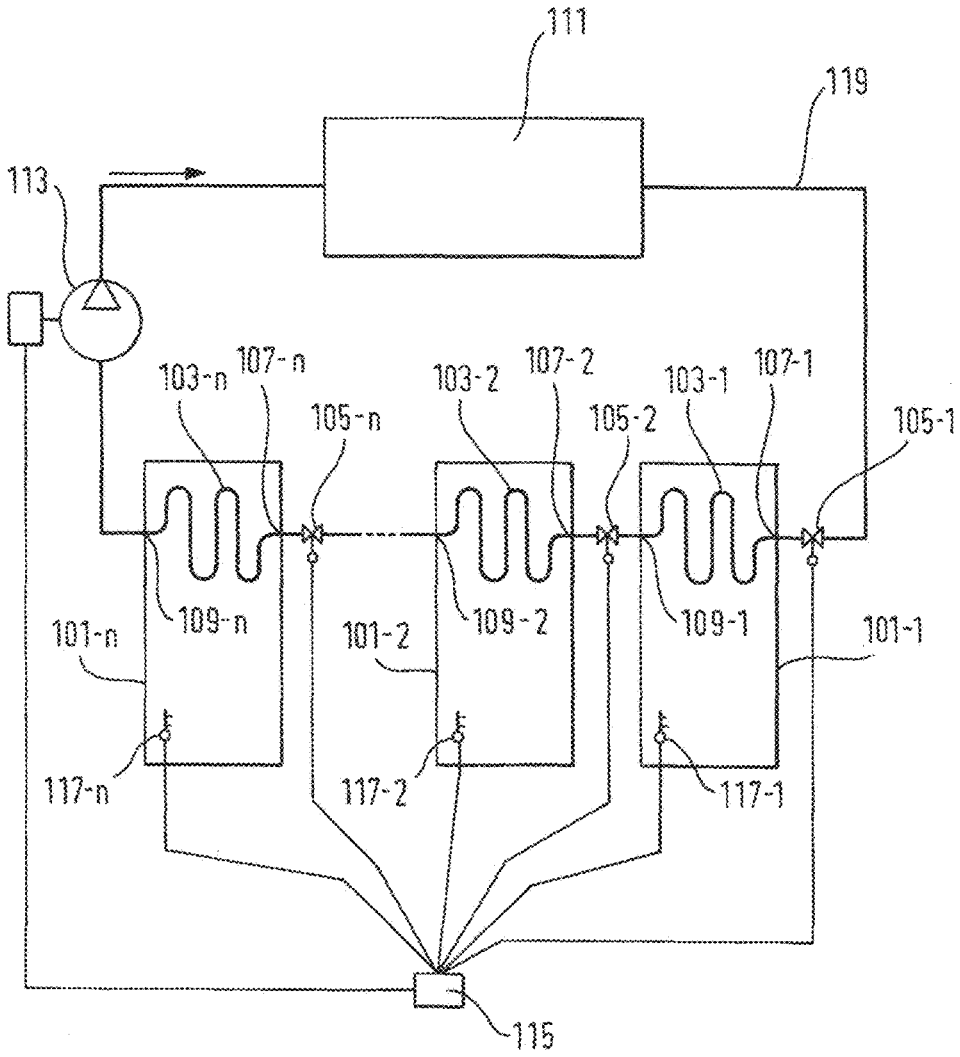
FIG. 2 shows a view of a refrigerant circuit with a number of evaporators.
Figure 3:
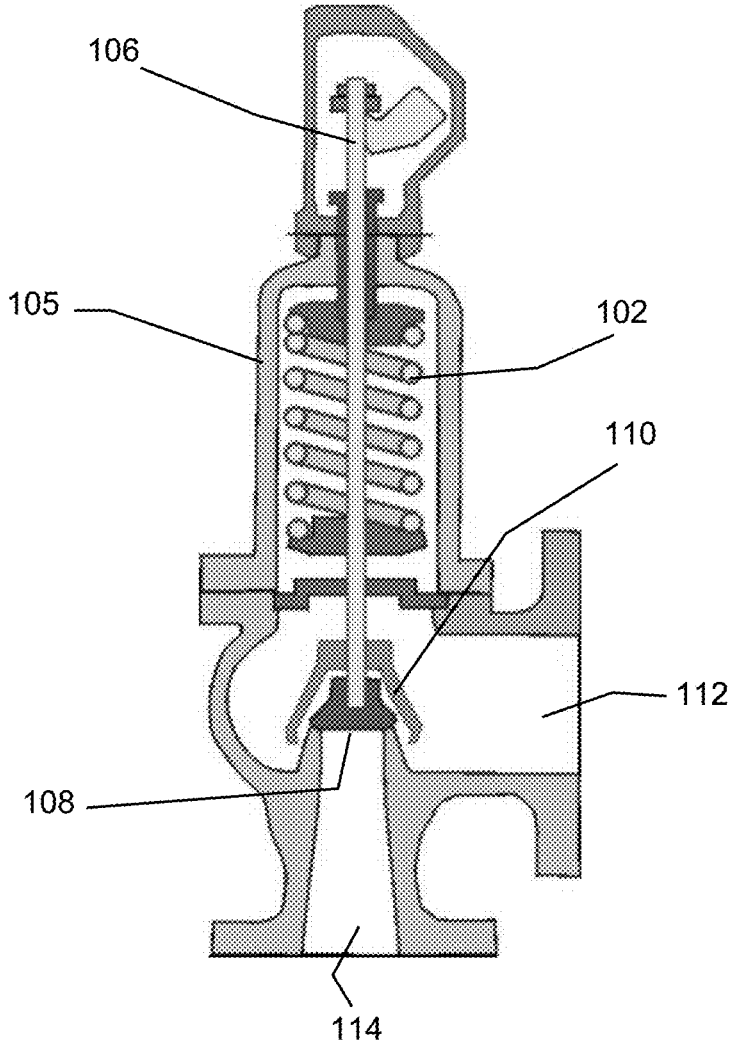
FIG. 3 PRIOR ART
FIG. 3 shows a longitudinal-section view of an expansion valve.

FIG. 2 shows a view of a refrigerant circuit 119 having a plurality of evaporators 103-1, 103-2, . . . , **103-*n*. The first evaporator 103-1 is arranged in a first refrigeration compartment 101-1 of the refrigeration device 100, the second evaporator 103-2 is arranged in a second refrigeration compartment 101-2 of the refrigeration device 100 and the third evaporator 103-*n* is arranged in a third refrigeration compartment 101-3 of the refrigeration device. Each of the evaporators comprises an expansion valve 105-1, 105-2, . . . , 105*n* upstream of its refrigerant inlet 107-1, 107-2, . . . , 107-*n* in each case. The evaporators 103-1, 103-2, . . . , 103-*n* are connected in series with one another. Here a refrigerant outlet 109-1 of the first evaporator 103-1 is connected to the second controllable expansion valve 105-2 at the refrigerant inlet 107-2 of the second evaporator (103-2). A refrigerant outlet 109-2 of the second evaporator 103-2 is connected to the third controllable expansion valve 105-*n* at the refrigerant inlet 107-*n* of the third evaporator 103-*n*. FIG. 3 shows an expansion valve 105 with a screw facility 106 for adjusting a needle 108 in a valve seat 110 against the force of a spring 102 between an inlet 112 and an outlet 114**.

The expansion valves 105-1, 105-2, . . . , **105-*n* can be controlled by a control unit 115. When the expansion valve 105-1, 105-2, . . . , 105-*n* is controlled, the cross-section and thus the pressure drop are regulated by the expansion valve 105-1, 105-2, . . . , 105-*n* in accordance with a suitable reference variable. In this case a throttling of the flow of refrigerant and a pressure drop take place. The reference variable may be the pressure in the assigned evaporator 103-1, 103-2, . . . , 103-*n* or the temperature in the respective refrigeration compartment 101-1, 101-2, . . . , 101-*n* for instance. The temperature in the refrigeration compartments 101-1, 101-2, . . . , 101-*n* is detected by respective temperature sensors 117-1, 117-2, . . . , 117-3**.

The temperature of the refrigeration compartments 101-1, 101-2, . . . , **101-*n* can be set by a customer and allows a large range of temperatures to be covered in the respective refrigeration compartments 101-1, 101-2, . . . , 101-*n***, for instance in a freezer compartment −18° C., a refrigeration compartment 5° C., in a VitaFresh compartment 0° C., in a wine storage compartment 12° C., in a defrost compartment −2 . . . +20° C., in a basement compartment +8 . . . +14° C. and in a maturity compartment +8 . . . +25° C.

A compression ratio between the individual evaporators 103-1, 103-2, . . . , **103-*n* in the refrigerant circuit 119 is maintained by controlling the expansion valves 105-1, 105-2 . . . , 105-*n*. If this is done using a plurality of expansion valves 105-1, 105-2, . . . , 105-*n*, the pressure between the expansion valves 105-1, 105-2, . . . , 105-*n*** is at a level which is proportional to the throttle ratio.

The entire throttling in the system amounts to $P_0-P_n$, wherein Po is the refrigerant pressure upstream of the first evaporator 103-1 and $P_n$ is the refrigerant pressure downstream of the n'th evaporator **103-*n*. The expansion valve 105-1 generates a pressure drop of $P_0-P_1$, wherein $P_1$ is the refrigerant pressure downstream of the first evaporator 103-1. The expansion valve 105-2 generates a pressure drop of $P_1-P_2$, wherein $P_2$ is the refrigerant pressure downstream of the second evaporator 103-2. The overall throttling from a condenser 111 to the second evaporator 103-2** amounts to $P_0-P_2$, i.e. $(P_0-P_1)+(P_1-P_2)$.

Since the expansion valves 105-1, 105-2, . . . , **105-*n* can be regulated individually, the first expansion valve 105-1 can be opened by one amount, while the second expansion valve 105-2 is closed with the same amount, so that the entire throttling $P_0-P_2$ remains the same. However, a higher refrigerant pressure prevails in the evaporator 103-1 in this case. As a result, the evaporator 103-1 has a higher evaporation temperature and the compartment temperature increases. The subsequent evaporator 103-2 experiences no difference in the refrigerant pressure. In the same way, the evaporator 103-2** can be set.

The temperatures of the evaporators 103-1, 103-2, . . . **103-*n* are not directly linked to the ambient temperature. If the expansion valve 105-1 is fully opened for instance, the first evaporator 103-1 can reach a temperature which is close to the condensing temperature. With an ambient temperature of 0° C., the condensing temperature is at approximately 15° C. As a result, the refrigeration compartment 101-1 can be heated. If the refrigeration device 100 is located in a garage or on a balcony, it is possible to prevent refrigerated goods from freezing. The refrigeration compartments 101-1, 101-2, . . . , 101-*n* will become increasingly colder in sequence. The evaporator 103-1 is thus the warmest and the evaporator 103-*n*** is the coldest.

If the compressor 113 has a minimum speed, a minimum refrigeration capacity is generated. If high temperatures are set in the first refrigeration compartments 101-1 and 101-2, the last refrigeration compartment 101-3 with the lowest temperature absorbs the remaining refrigeration capacity. It may be that the temperature in the last refrigeration compartment 101-3 is lower than that initially set. The quality of the frozen refrigerated goods is however not negatively influenced by an even lower temperature.

In order to keep the temperatures in the refrigeration compartments 101-1, 101-2, . . . , **101-*n* constant, the compressor 113 is in continuous operation. When an evaporator 103-1, 103-2, . . . , 103-*n* is defrosted, the evaporation temperature can briefly be set to above the freezing point. This is however only rarely necessary since on account of the continuous operation of the compressor 113, the temperature difference between the evaporators 103-1, 103-2, . . . , 103-*n* and the respective refrigeration compartments 101-1, 101-2, . . . , 101-*n* is low. Under standard conditions it is therefore not necessary to defrost the respective evaporator 103-1, 103-2, . . . , 103-*n*** since this has a temperature of above 0° C.

The compressor 113 has a speed control so that various high refrigeration capacities and low temperatures can be set. High refrigeration capacities at low temperatures are achieved with high speeds.

The customer has the option of efficiently regulating the temperature of one or a plurality of refrigeration compartments 101-1, 101-2, . . . **101-*n* in accordance with his requirements. Since this regulation is performed by way of the refrigerant circuit 119**, this is more efficient than comparable solutions with an electrical heater. By developing temperature ranges of above 14° C., new storage options can be developed for customers, such as for instance the selective maturing of fruit and vegetables or the storage of bread.

The respective temperatures in the individual refrigeration compartments 101-1, 101-2, . . . , **101-*n* of the refrigeration device 100 can be regulated easily and independently of one another so that freezer compartment temperatures below −18° C. and temperature above ambient temperature can be achieved at the same time without an electrical heater being used for this purpose. The individual refrigeration compartments 101-1, 101-2, . . . , 101-*n* can be regulated without influencing the temperatures in the remaining refrigeration compartments 101-1, 101-2, . . . , 101-*n*. Moreover, the temperatures in the refrigeration compartments 101-1, 101-2, . . . , 101-*n*** are kept at an extremely stable level.

A precise temperature control with significantly reduced fluctuation is achieved by the series connected evaporators 103-1, 103-2, . . . , **103-*n*. This produces advantages for stored refrigerated goods for instance. A reduced loss of fresh weight takes place with fresh fruit and vegetables, since transpiration processes are minimized and the breathing activity is reduced. A reduced condensation takes place in packaged products, in particular MAP packaging, so that food safety is increased. Moreover, the sensory product reception is improved. With frozen storage, a reduction in the recrystallization, an improved texture preservation and reduced losses due to dropping are achieved. Moreover, a constant refrigerator compartment temperature of 5° C. can be ensured irrespective of the ambient temperature, for instance at ambient temperatures of below 5° C. As a result, the customer can use the refrigeration device 100** in accordance with his requirements.

All features shown and explained in conjunction with individual embodiments of the invention can be provided in a different combination in the inventive subject matter in order at the same time to realize its advantageous effects.

The scope of protection of the present invention is provided by the claims and is not restricted by the features explained in the description or shown in the Figures.

LIST OF REFERENCE CHARACTERS

100 Refrigeration appliance
101 Refrigeration compartment
103 Evaporator
105 Expansion valve
107 Refrigerant inlet
109 Refrigerant outlet
111 Condenser
113 Compressor
115 Control unit
117 Temperature sensor
119 Refrigerant circuit

The invention claimed is:

1. A refrigeration device, comprising:

a first refrigeration compartment for storing refrigerated goods at a first temperature, said first refrigeration compartment including a first evaporator having a refrigerant inlet, a refrigerant outlet and a first controllable expansion valve at said refrigerant inlet of said first evaporator; and a second refrigeration compartment for storing refrigerated goods at a second temperature, said second refrigeration compartment including a second evaporator having a refrigerant inlet and a second controllable expansion valve at said refrigerant inlet of said second evaporator;

said refrigerant outlet of said first evaporator being connected to said second controllable expansion valve at said refrigerant inlet of said second evaporator;

a control unit for controlling said expansion valves;

wherein said control unit is configured to control said first and second expansion valves to maintain a constant flow of refrigerant through said first evaporator.

2. The refrigeration device according to claim 1, wherein said control unit has a non-volatile memory for saving a control program.

3. The refrigeration device according to claim 1, wherein the first temperature is higher than the second temperature.

4. The refrigeration device according to claim 1, wherein said second refrigeration compartment is a freezer compartment for storing refrigerated goods at a temperature below 0° C.

5. The refrigeration device according to claim 1, which further comprises a compressor with a regulatable speed.

6. The refrigeration device according to claim 5, wherein said control unit is configured to control a speed of said compressor on a basis of a predetermined refrigeration capacity.

7. The refrigeration device according to claim 1, wherein said first expansion valve or said second expansion valve is steplessly adjustable.

8. The refrigeration device according to claim 1, wherein said first expansion valve or said second expansion valve includes a screw facility with a linear stroke for regulating a flow of refrigerant.

9. The refrigeration device according to claim 1, which further comprises:

a third refrigeration compartment for storing refrigerated goods at a third temperature, said third refrigeration compartment including a third evaporator having refrigerant inlet and a third controllable expansion valve at said refrigerant inlet of said third evaporator;

said second evaporator having a refrigerant outlet connected to said third controllable expansion valve at said refrigerant inlet of said third evaporator.

10. A refrigeration device, comprising:

a first refrigeration compartment for storing refrigerated goods at a first temperature, said first refrigeration compartment including a first evaporator having a refrigerant inlet, a refrigerant outlet and a first controllable expansion valve at said refrigerant inlet of said first evaporator; and a second refrigeration compartment for storing refrigerated goods at a second temperature, said second refrigeration compartment including a second evaporator having a refrigerant inlet and a second controllable expansion valve at said refrigerant inlet of said second evaporator;

said refrigerant outlet of said first evaporator being connected to said second controllable expansion valve at said refrigerant inlet of said second evaporator;

a control unit for controlling said expansion valves;

wherein said control unit is configured to control said first and second expansion valves to increase a flow of refrigerant through said first expansion valve if a flow of refrigerant through said second expansion valve is reduced.

11. A refrigeration device, comprising:

a first refrigeration compartment for storing refrigerated goods at a first temperature, said first refrigeration compartment including a first evaporator having a refrigerant inlet, a refrigerant outlet and a first controllable expansion valve at said refrigerant inlet of said first evaporator; and a second refrigeration compartment for storing refrigerated goods at a second temperature, said second refrigeration compartment including a second evaporator having a refrigerant inlet and a second controllable expansion valve at said refrigerant inlet of said second evaporator;

said refrigerant outlet of said first evaporator being connected to said second controllable expansion valve at said refrigerant inlet of said second evaporator;

a control unit for controlling said expansion valves;

wherein said control unit is configured to control said first and second expansion valves to reduce a flow of refrigerant through said first expansion valve if a flow of refrigerant through said second expansion valve is increased.

12. A refrigeration device, comprising:

a first refrigeration compartment for storing refrigerated goods at a first temperature, said first refrigeration compartment including a first temperature sensor, a first evaporator having a refrigerant inlet, a refrigerant outlet and a first controllable expansion valve at said refrigerant inlet of said first evaporator; and a second refrigeration compartment for storing refrigerated goods at a second temperature, said second refrigeration compartment including a second temperature sensor, a second evaporator having a refrigerant inlet and a second controllable expansion valve at said refrigerant inlet of said second evaporator;

said refrigerant outlet of said first evaporator being connected to said second controllable expansion valve at said refrigerant inlet of said second evaporator;

a control unit for controlling said expansion valves; and wherein said control unit is configured to control said first expansion valve and said second expansion valve based on a first measured temperature value from said first temperature sensor and a second measured temperature value from said second temperature sensor.

* * * * *